United States Patent [19]

Astheimer

[11] 4,435,149

[45] Mar. 6, 1984

[54] METHOD AND APPARATUS FOR MONITORING THE BURNING EFFICIENCY OF A FURNACE

[75] Inventor: Robert W. Astheimer, Westport, Conn.

[73] Assignee: Barnes Engineering Company, Stamford, Conn.

[21] Appl. No.: 328,010

[22] Filed: Dec. 7, 1981

[51] Int. Cl.[3] ..... F23N 1/02

[52] U.S. Cl. ..... 431/12; 431/79; 250/339

[58] Field of Search ..... 431/75, 76, 79, 12; 250/339, 340, 351

[56] References Cited

U.S. PATENT DOCUMENTS 4,179,606 12/1979 Nakauchi et al. ..... 250/339

*Primary Examiner*—Samuel Scott
*Assistant Examiner*—Allen J. Flanigan
*Attorney, Agent, or Firm*—Parmelee, Bollinger & Bramblett

[57] ABSTRACT

A furnace burner flame monitoring method and apparatus are provided for controlling the burner fuel mixture in order to operate a furnace at maximum burning efficiency. A radiometer having an infrared detector views the flame and detects infrared radiation emitted from the flame. A filter wheel is interposed between the infrared detector and the flame for transmitting at least three different, discrete, infrared radiation bands from the flame to the detector with the detector thereby generating at least three signals in response to radiation received from the three infrared radiation bands. A control parameter is derived using a ratio of at least two of the signals from the infrared radiation bands which are compensated for flame length using a third of the signals generated by the infrared detector. The control parameter may then be utilized for controlling the fuel/air mixture which is burned for thus monitoring and maintaining the furnace at maximum efficiency.

6 Claims, 1 Drawing Figure

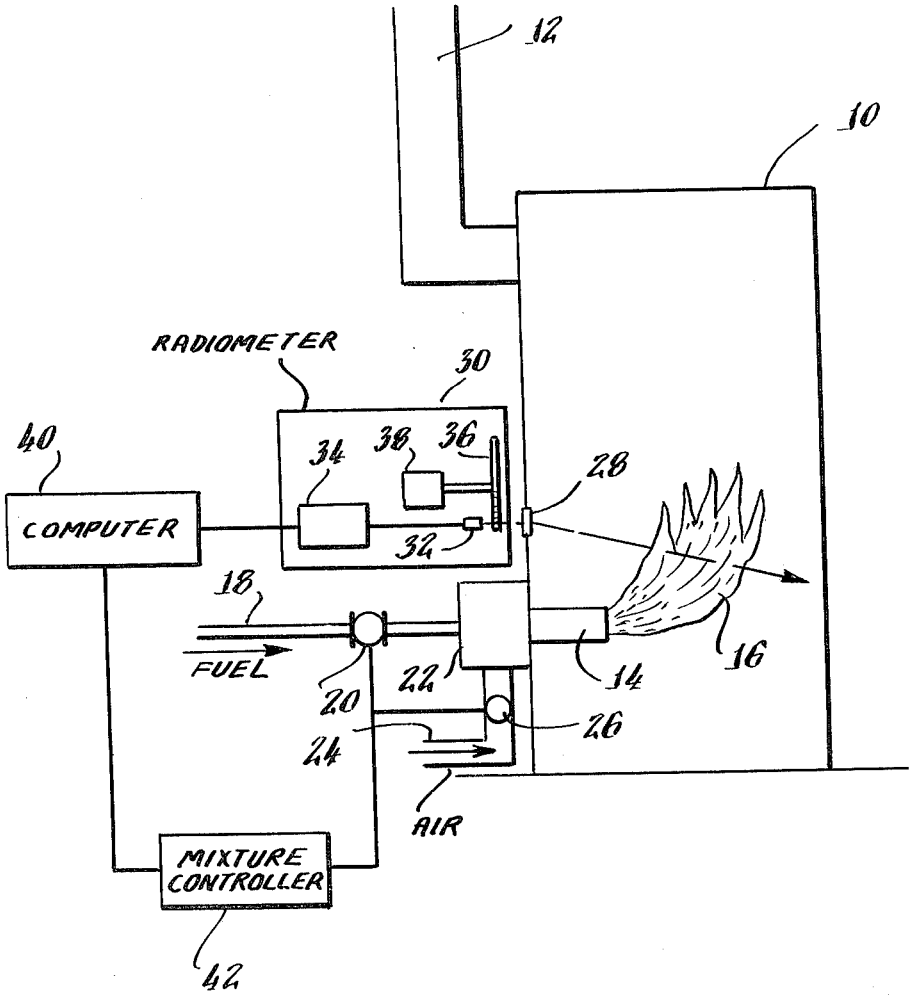
12
10
RADIOMETER
30
40
34
38
36
28
COMPUTER
32
18
FUEL
20
22
14
16
24
26
AIR
MIXTURE CONTROLLER
42

METHOD AND APPARATUS FOR MONITORING THE BURNING EFFICIENCY OF A FURNACE

BACKGROUND OF THE INVENTION

This invention relates to a method and apparatus for monitoring the burning efficiency of a furnace, and more particularly to such a method and apparatus which measures infrared radiation emitted by the flame of the furnace in at least three different wavelengths and deriving a control parameter based on the ratio of the measurements of two of the wavelengths compensated for flame length by the third measurement.

A variety of methods and apparatus have been used for monitoring combustion systems for the purpose of controlling and maximizing combustion efficiency. Some systems monitor stack gases and develop a control parameter based thereon which is used, for example, to control the air/fuel ratio. Other control systems monitor the temperature of the flame to control the input parameters. However, all of these systems are not totally satisfactory due to various factors such as the environments in which the measurements are made, complexity of the systems, response time, the problem of which burner to control when monitoring flue gases, etc.

In U.S. Pat. No. 4,179,606 a flame sensor is provided for automatically monitoring and controlling the combustion of a flame by viewing the flame in two specific wave bands and providing a ratio of the output of the radiation received from such bands to monitor and/or control the combustion. However, this approach fails to take into account the varying path lengths of the measurements through the flame which determine the prescribed ratio. In other words, varying burning rates of the fuel are not taken into account and as different fuel rates are applied to the burner the flame lengthens, and the measurements which are made on the flame will have different path lengths through the flame. Thus, the flame would have measurements taken at different penetration levels in accordance with the varying load rates. Thus, no compensation is provided for the varying amounts of fuel which are being applied and burned in the burners and full efficiency is not achieved.

SUMMARY OF THE INVENTION

Accordingly, it is an object of this invention to provide an improved method and apparatus for automatically monitoring and controlling the burning efficiency of a single or multiple fired furnace.

Another object of this invention is to provide a new and improved method and apparatus which provides compensation for varying fuel burning rates in a monitored and controlled furnace.

In carrying out this invention, in one illustrative embodiment thereof a method and apparatus are provided for monitoring and/or controlling the burning efficiency of a furnace having variable fuel burning rates in which the flame or flames are viewed by an infrared detector of a radiometer and measurements are made of the infrared radiation emitted by the flame in at least three different wavelengths in which the first wavelength represents a strong emission band of carbon dioxide, a second wavelength represents a weak emission band of water and carbon dioxide and a third wavelength represents a band where none of the furnace gases absorb. A control parameter is derived by taking the ratio of the measurements of third and first wavelengths which is corrected by the measurement made at the second wavelength to compensate for the length of the flame which varies with load conditions. The control signal may be applied to the furnace for varying the fuel to air mixture thereby maximizing the burning efficiency of the furnace.

BRIEF DESCRIPTION OF THE DRAWING

The invention, together with further objects, advantages and features thereof will be more clearly understood from the following description taken in conjunction with the accompanying drawing.

The drawing is an elevational view in diagramatic form of a furnace having an ignited flame therein and includes the optical components and electric circuitry in block form illustrating a means for monitoring the flame of a burner and controlling the flow of fuel/air or both thereto.

DESCRIPTION OF THE PREFERRED EMBODIMENT

Referring now to the drawing, a furnace, referred to generally with the reference numeral 10, has a flue 12 and a burner 14 which generated a flame 16. Oil is applied to the burner 14 via a fuel line 18 and a control valve 20. Air is applied to the wind box 22 of the furnace 10 through a conduit 24 and a control valve 26. Although only one burner is shown, it will be appreciated that a plurality of burners may be provided which substantially duplicate that shown and each may be controlled in a similar manner. If several burners are utilized in the furnace 10, they will ordinarily be arranged in a row or rows which include the burner 14.

In order to monitor and/or control the fuel/air mixture of the furnace illustrated in the drawing, a window or peep hole 28 is provided in the furnace 10 which provides a clear view of the flame 16 from the burner 14.

The flame is monitored by a filter wheel radiometer, referred to generally with the reference numeral 30. The filter wheel radiometer 30 is conventional and includes an infrared detector 32 which is sensitive to the wavelengths of radiation which are to be monitored. In the monitoring of a flame the infrared wave bands primarily of interest are the near to middle infrared and, accordingly, infrared detectors suitable for covering those wavelengths will be used such as a lead selenide or pyroelectric detectors. The infrared detector 32 is coupled to an amplifier 34 for processing and amplifying the detected infrared radiation.

The radiometer 30 also includes an optical element in the form of a rotating filter wheel 36 which is driven by a motor 38 interposed between the window 28 and the infrared detector 32. The purpose of the filter wheel 36 is to apply selected bands of radiation from the flame 16 to the infrared detector 32. In accordance with the present invention at least three frequency bands are required as will be explained hereinafter. Accordingly, the filter wheel 36 has three filters mounted therein which may be conventional interference filters or any other type which pass the radiation bands in question. Accordingly, the infrared detector 32 will view the flame 16 through the window 28 in at least three wave bands generating separate signals representing the flame emission in those bands.

It is believed that the basic "oxygen" ratio $$R_o = \frac{(3.8\mu - 4.1\mu \text{ Band})}{(4.4\mu - 4.6\mu \text{ Band})}$$

is a measure of unburned particulates in the flame. The numerator is the radiance in the $3.8\mu-4.1\mu$ band, which is in a region of minimum $CO_2$ and $H_2O$ emission. These are the major combustion products. The emission in this band, called $P_p$, will then be primarily due to black body radiation from particulates in the flame. $P_p$ will be proportional to the product of particulate concentration C, flame temperature T and view path length L through the flame. Thus:

$$P_p \sim C\,T\,L \quad (1)$$

The denominator called $P_f$ is the radiance in a strong $CO_2$ emission band ($4.4\mu-4.6\mu$) and can be considered primarily indicative of flame temperature. The absorption in this region is so strong that the view path probably never penetrates the flame, thus $P_f \sim T$. Then:

$$R_o = (P_p/P_f) \sim (C\,T\,L/T) \sim CL \quad (2)$$

The particulate concentration may be assumed to be the factor which depends only on the excess oxygen and is what is desired to be measured, thus $C = f(O_2)$ and therefore:

$$R_o \sim L \times f(O_2) \quad (3)$$

The view path length L is the load dependent factor which must be corrected. As the fuel burning rate increases, the flame will grow in size and L will increase. The "load" ratio $R_L$ has for its numerator the radiance in a weaker band ($2.6\mu-2.9\mu$) where the view path penetrates the flame and is proportional to T L, while the denominator is the same as for $R_o$. Thus $$R_L \sim (T\,L/T) \sim L \quad (4)$$

The control parameter $R_c$ then becomes:

$$R_c = (R_o/R_L) \sim (L\,f(O_2)/L) \sim f(O_2) \quad (5)$$

The foregoing has, of course, been greatly oversimplified and the form of $R_c = f\,(R_o, R_L)$ is somewhat different than given in Equations 5. The general form of the control parameter is $$R_c = R_o/(R_L - K) \quad (6)$$

where K is a constant for a given burner and fuel type. However, this concept explains qualitatively when the algorithm works.

Accordingly, by deriving signals in the three wave bands, one of which represents radiation from the particulates, one in effect which represents the temperature of the flame and a third of which represents the path length or thickness of the flame, a suitable control parameter may be provided for developing a combustion control algorithm.

The signals from the radiometer 30 are applied to a computer 40 where the computation is made in accordance with Equation (6). The control parameter $R_c$ is applied to the mixture controller 42 which applies control signals to the fuel valve 20 and air valves 26 for providing a flame 16 which is operating at maximum efficiency. It should be pointed out that variations in load are the most troublesome aspect of developing a combustion control algorithm. When the load is held constant the oxygen ratio $R_o$ appears to be a good measure of excess air. However, the present invention is directed to the more common and difficult case in which fuel is burned at varying rates.

In the case of multiple burners in the same furnace each flame will be monitored and individually controlled. This method of a control would not be available if the stack gas of a furnace which had multiple flames was being monitored, since it would not be known which flame was burning inefficiently. It should also be pointed out that a multi-element filter wheel 36 is convenient but not essential and an optical element such as a grating or prism may be used in place of the filter wheel along with separate detectors for receiving the infrared wave bands that are separated by these optical elements. The signals obtained, of course, would be processed in the same manner.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention.

What is claimed is:

1. The method of monitoring the burning efficiency of a furnace having variable burning rates comprising the steps of:

viewing the flame of said furnace with an infrared detector in a manner such that the thickness of the section of the flame viewed by the detector varies with the burner feeding rate, measuring the infrared radiation emitted by said flame in at least three different wavelengths, having a first wavelength representing a strong emission band of carbon dioxide, a second wavelenth representing a weak emission band of water and carbon dioxide, and a third wavelength reprsenting a band where none of the furnace gases absorb, deriving a control parameter based on the ratio of the measurements of the third to the first wavelengths corrected by the measurement of said second wavelength, and applying said control parameter to said furnace for varying the fuel to air mixture for maximizing the burning efficiency of said furnace.

2. The method set forth in claim 1 in which the step of measuring infrared radiation in at least three wavelengths includes bands ($3.8\mu-4.1\mu$), $4.4\mu-4.6\mu$), and ($2.6\mu-2.9\mu$).

3. A furnace burner flame monitoring apparatus for controlling the burner fuel mixture of a furnace having a burner to which the fuel mixture is applied and burned generating a flame in order to operate the furnace at maximum burning efficiency comprising:

radiometric means having infrared detector means which is oriented relative to the burner such that the thickness of the section of the flame viewed by the detector varies with the feed rate, and which views said flame and detects infrared radiation applied thereto from said flame, optical means interposed between said infrared detector means and said flame for applying at least three different, discrete infrared radiation bands from said flame to said infrared detector means, said infrared detector means generating at least three signals in response to radiation received from said three infrared radiation bands and means for deriving a control parameter using a ratio of at least two of said signals which is compensated for path length using the third of said signals.

4. The furnace burner flame monitoring apparatus set forth in claim 3 in which said optical means comprises a rotating filter wheel having at least three different interference filters therein for applying radiation from said three infrared radiation bands to said detector means.

5. The furnace burner flame monitoring apparatus set forth in claim 3 or 4 in which said three different infrared radiation bands comprise ($3.8\mu-4.1\mu$), a region where none of the furnace gases absorb, ($4.4\mu-4.6\mu$) a strong emission band for carbon dioxide and ($2.6\mu-2.9\mu$) a weak emission band of $CO_2$ and $H_2O$.

6. The furnace burner flame monitoring apparatus set forth in claim 3 or 4 in which said infrared radiation bands represent the black body radiation from particulates in the flame, the temperaure of the flame and view path length of the flame.

* * * * *